US012104605B2

(12) United States Patent
Mosiewicz

(10) Patent No.: US 12,104,605 B2
(45) Date of Patent: Oct. 1, 2024

(54) ROTOR AND AXIAL VENTILATOR COMPRISING AN ACCESSORY AXIAL FAN

(71) Applicant: R.E.M. PATENTS S.R.L., Arona (IT)

(72) Inventor: Roberto Eduardo Mosiewicz, Arona (IT)

(73) Assignee: R.E.M. PATENTS S.R.L., Arona (IT)

( * ) Notice: Subject to any disclaimer, the term of this patent is extended or adjusted under 35 U.S.C. 154(b) by 0 days.

(21) Appl. No.: 18/565,246

(22) PCT Filed: May 19, 2022

(86) PCT No.: PCT/IB2022/054662
§ 371 (c)(1),
(2) Date: Nov. 29, 2023

(87) PCT Pub. No.: WO2022/254276
PCT Pub. Date: Dec. 8, 2022

(65) Prior Publication Data

US 2024/0263635 A1 Aug. 8, 2024

(30) Foreign Application Priority Data

May 31, 2021 (IT) ..... 102021000014219

(51) Int. Cl.
*F04D 19/00* (2006.01)
*F04D 29/32* (2006.01)
*F04D 29/54* (2006.01)

(52) U.S. Cl.
CPC ..... *F04D 19/007* (2013.01); *F04D 19/002* (2013.01); *F04D 29/325* (2013.01); *F04D 29/545* (2013.01)

(58) Field of Classification Search
CPC .... F04D 19/007; F04D 19/002; F04D 29/325; F04D 29/545
See application file for complete search history.

(56) References Cited

U.S. PATENT DOCUMENTS

2014/0086730 A1 3/2014 Chang
2016/0138601 A1 5/2016 Gallina
(Continued)

FOREIGN PATENT DOCUMENTS

CA 3142393 A1 12/2020
CN 108026936 A 5/2018
(Continued)

OTHER PUBLICATIONS

International Search Report issued on Sep. 15, 2022, in corresponding International Application No. PCT/IB2022/054662, 3 pages.
(Continued)

*Primary Examiner* — Aaron R Eastman
(74) *Attorney, Agent, or Firm* — Maier & Maier, PLLC

(57) ABSTRACT

A rotor for a large-diameter axial ventilator for industrial use. The rotor includes a hub and n blades, where each rotor blade includes a root portion for the structural connection to the hub and an aerodynamic portion; the rotor further includes a coaxial accessory axial fan including n radially extending vanes which, in an axial view, is substantially included within the region P defined by the n radially inner ends of the aerodynamic portions of the rotor blades. The embodiments further relates to a large-diameter axial ventilator for industrial use including such a rotor.

15 Claims, 14 Drawing Sheets

(56) References Cited

U.S. PATENT DOCUMENTS

| | | | | |
|---|---|---|---|---|
| 2017/0002833 | A1* | 1/2017 | Lin | F04D 29/281 |
| 2018/0112675 | A1 | 4/2018 | Neff et al. | |

FOREIGN PATENT DOCUMENTS

| | | | |
|---|---|---|---|
| CN | 211177176 | U | 8/2020 |
| JP | S4311173 | Y1 | 5/1968 |
| JP | 2019060296 | A | 4/2019 |
| KR | 20010004764 | A | 1/2001 |
| KR | 1020120011506 | A | 2/2012 |
| WO | 2014117288 | A1 | 8/2014 |
| WO | 2020245674 | A1 | 12/2020 |
| WO | 2021063050 | A1 | 4/2021 |

OTHER PUBLICATIONS

Written Opinion issued on Sep. 15, 2022, in corresponding International Application No. PCT/IB2022/054662, 5 pages.
Office Action issued on May 3, 2024, in corresponding Korean Application No. 10-2023-7045037, 12 pages.
Office Action issued on Apr. 10, 2024, in corresponding Chinese Application No. 202280039427.5, 10 pages.
Office Action issued on Jun. 11, 2024, in corresponding Japanese Application No. 2023-580962, 13 pages.

* cited by examiner

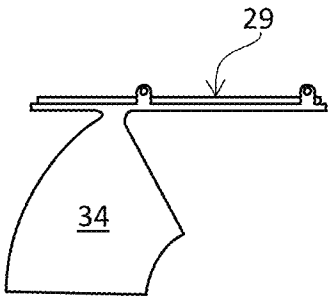
Fig. 22.a
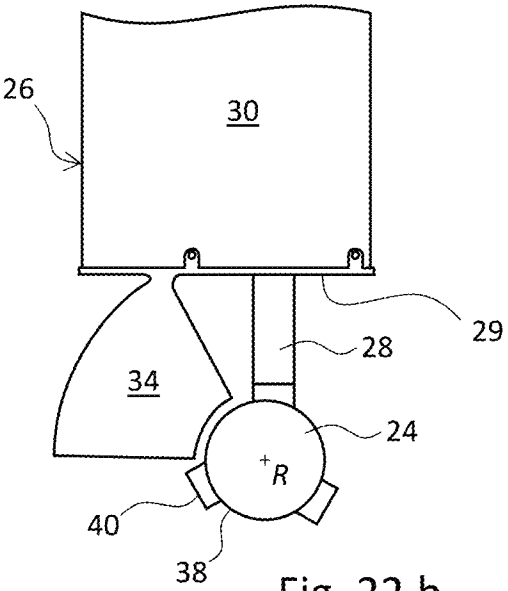
Fig. 22.b
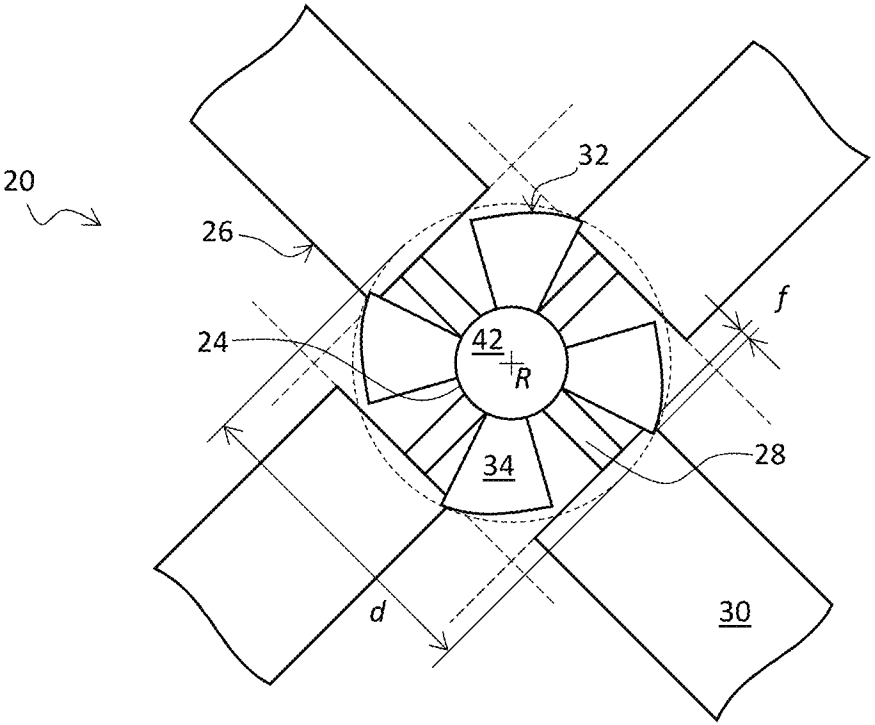
Fig. 21

ROTOR AND AXIAL VENTILATOR COMPRISING AN ACCESSORY AXIAL FAN

TECHNICAL FIELD

The present invention relates to the field of axial ventilators, especially large-diameter axial ventilators for industrial use.

BACKGROUND

In the industrial sector, axial ventilators are known to be used to ensure adequate airflow around special radiant surfaces in plants requiring the dissipation of significant amounts of heat.

The axial ventilators, for example for industrial use, comprise a central hub on which a plurality of blades are mounted. The hub defines an axis around which it rotates the blades. Each blade usually comprises a root portion and a portion called aerodynamic, i.e., a portion shaped according to an airfoil. The root portion has the purely structural function of constraining the blade to the hub, while the aerodynamic portion has the function of interacting with the air. As those skilled in the art can well understand, the tangential velocities are different for different blade sections. In fact, the tangential velocity of each blade section is the product of the angular velocity (which is the same for all sections) and the radial distance with respect to the rotation axis (which increases moving away from the rotation axis).

For this reason, as those skilled in the art know, axial ventilator blades do not operate in an equally effective manner across their entire radial aperture. The tangential velocity of the radially innermost sections of the blade is often considered too low to achieve effective relative motion with respect to the airflow. It follows that the actual operation of the ventilator relies mainly on the radially outer sections, which ensure almost the entire air flow generated by the axial ventilator.

The lines of the flow hitting a single blade are theoretically circumference arcs whose centre coincides with the rotation axis. However, such a theoretical flow line trend is only reflected in reality for the central sections of the blade. In contrast, at the radially inner and radially outer ends of the blade, the flow lines are altered by so-called end effects, which are briefly described below.

Along the intermediate portions of the blade, the high-pressure air zone and the low-pressure air zone are physically separated from each other by the presence of the blade itself. At the ends of the blade, this separation ceases to exist and therefore an airflow is spontaneously generated, which tends to move from the high-pressure zone into the low-pressure zone. This thereby generates end vortices that significantly limit the efficiency of the ventilator. Furthermore, the end vortices, sucking in the surrounding air, introduce alterations in the flow lines. Such alterations extend, both from the outer and inner ends, towards the central sections of the blade, affecting a significant percentage of the entire radial extension of the blade. For this reason, in many known axial ventilators a large portion of the blade works away from the optimal operating point represented by the theoretical flow lines.

The problem of end effects has often been addressed for the radially outer end, since it is adjacent to the area of the blade which, as mentioned above, most contributes to the overall aerodynamic work of the blade.

An initial solution proposed to counteract the effects of the vortex at the outer end was to intubate the ventilator, thus confining it within a tube having a diameter slightly larger than the outer diameter of the ventilator itself. Such a tube is referred to hereafter as duct.

With the addition of the duct, the size of the vortices at the outer end is significantly reduced, and consequently the amount of air moved by such vortices, and thus the induced resistance, is decreased. However, not only is it impossible to eliminate the distance between the outer end of the blades and the inner diameter of the duct, but such a distance cannot even be reduced beyond a certain limit.

Another solution, borrowed from aeronautics, is to provide an accessory surface called a winglet at the outer end of each blade. The winglet's primary function is to form a wall that opposes the motion of air, counteracting the formation of the end vortex. Furthermore, depending on the shapes adopted, the winglet can also affect the residual end vortex, optimising it and thus limiting noise formation.

A further solution is described in international patent application WO 2020/245674, on behalf of the same applicant. Such a solution, hereinafter called "annular seat" for short, is briefly described below, while the reader is referred to the same publication WO 2020/245674 for a more detailed description. In accordance with such a solution, an annular seat is provided on the inner wall of the duct, which extends circumferentially around the ventilator rotor and partially accommodates the outer blade ends. In particular, the annular seat is open in the axial direction and an axial baffle defined by the winglet mounted at the end of each blade runs therein. This particular configuration defines a sort of labyrinth that effectively counteracts the motion of air around the outer end of the blade. The annular seat therefore implies considerable advantages in terms of overall ventilator efficiency.

With regard to the radially inner end of the blades, the use of a flat disc to arrange in the hub area has been proposed in an attempt to interpose an obstacle that physically prevents recirculation of air.

Patent document WO 2014/117288 describes a rotor for an axial ventilator comprising an accessory centrifugal fan. The accessory centrifugal fan is mounted in the centre of the rotor, coaxial thereto. In such a solution, the accessory centrifugal fan generates an airflow directed radially outwards that hits the radially inner ends of the rotor blades, with the aim of counteracting the recirculation due to the end effect.

Although widely appreciated, the known solutions described above are not without disadvantages. In fact, compared to the various solutions described above for addressing the problem of vorticity at the radially outer end of the blade, to date there are no known proposals for addressing the vorticity at the radially inner end. Probably the low recognised aerodynamic contribution of the radially inner area of the blade has always made designers think that any intervention in this area could not achieve any noteworthy results on the overall behaviour of the ventilator.

Furthermore, experimental campaigns have shown that the addition of the flat disc in the hub area does not imply any real benefit in terms of ventilator efficiency.

The need is therefore felt for an industrial axial ventilator in which the behaviour of the radially inner area of the rotor in terms of vorticity is improved.

SUMMARY

The object of the present invention is therefore to overcome the drawbacks highlighted above in relation to the prior art.

In particular, a task of the present invention is to provide an axial ventilator with improved efficiency.

Furthermore, a task of the present invention is to provide an axial ventilator that, with respect to the known type of ventilators, can develop higher pressures at the same velocity.

Furthermore, a task of the present invention is to provide an axial ventilator that limits the formation of end vortices more with respect to the known types of ventilators.

Again, a task of the present invention is to provide an axial ventilator which allows flow lines to be regularised by making them as similar as possible to those predicted by theory.

Finally, a task of the present invention is to provide a ducted axial ventilator that not only introduces further advantages, but also retains the advantages already achieved by the known types of ventilators.

These and other objects and tasks of the present invention are achieved by a rotor in accordance with claim 1 and by a ventilator in accordance with claim 10. Further features are identified in the dependent claims. All the attached claims form an integral part of the present description.

In accordance with a first aspect, the invention relates to a rotor for a large-diameter axial ventilator for industrial use. The rotor comprises a hub and n blades, with each rotor blade comprising a root portion for the structural connection to the hub and an aerodynamic portion. The rotor further comprises an accessory axial fan which comprises n radially extending vanes and which, in an axial view, is substantially comprised within the region P defined by the n radially inner ends of the aerodynamic portions of the blades of the rotor.

The presence of the accessory axial fan stabilises the velocity and pressure range in the radially inner area of the rotor, so that the latter works better, increasing the overall efficiency of the ventilator.

Preferably, in an axial view, the accessory axial fan 32 is inscribed within the region P. Such a feature allows to best exploit the extension of the region P without introducing interference between the accessory axial fan and the main rotor.

In some embodiments, the accessory axial fan comprises a central portion from which the n vanes protrude radially. In other embodiments, the accessory axial fan is obtained by attaching the n vanes directly to the rotor hub.

In some embodiments, the accessory axial fan is made in a single, monolithic piece. In some embodiments, the vanes of the accessory axial fan comprise a root portion for the structural connection to the hub, and an aerodynamic portion.

These different embodiments of the accessory axial fan and the respective vanes allow the accessory axial fan to be optimally adapted to different requirements.

Preferably the radial extension of the vanes of the accessory axial fan is comprised between 60% and 75% of the radius of the accessory axial fan, even more preferably between 65% and 70% of the radius of the accessory axial fan.

Preferably the axial extension of the vanes of the accessory axial fan is comprised within 20% of the accessory axial fan diameter, even more preferably between 5% and 15% of the accessory axial fan diameter.

Preferably the thickness of each accessory axial fan vane is substantially uniform over the entire extension of the vane. Preferably the thickness of the vanes of the accessory axial fan is comprised between 10% and 20% of the axial extension of the vanes of the accessory axial fan.

Based on the experiments conducted, these proportions of the accessory axial fan achieve particularly positive results in terms of increasing the overall efficiency of the rotor.

In some embodiments of the rotor, at least one blade comprises a winglet at the radially outer end, in which the winglet comprises a baffle extending in the axial and circumferential directions.

In accordance with a second aspect, the invention relates to an industrial ventilator comprising a rotor in accordance with the above and a motor.

In some embodiments, the ventilator also comprises a duct surrounding the rotor. Preferably, the duct comprises an annular seat that extends circumferentially around the rotor and partially accommodates the outer ends of the rotor blades. Preferably, the annular seat extends at least partially in the axial direction and partially accommodates a baffle defined by a blade winglet.

Such a ventilator configuration stabilises the velocity and pressure range both in the radially inner rotor area, thanks to the accessory axial fan, and in the radially outer rotor area, thanks to the annular seat that houses the baffle. Thereby the ventilator works at its best, increasing its overall efficiency.

Further features and advantages of the present invention will be more evident from the description of the accompanying drawings.

BRIEF DESCRIPTION OF THE DRAWINGS

The invention is described hereinbelow with reference to certain examples provided by way of non-limiting example and illustrated in the accompanying drawings. These drawings illustrate different aspects and embodiments of the present invention and reference numerals illustrating structures, components, materials and/or similar elements in different drawings are indicated by similar reference numerals, where appropriate. Moreover, for clarity of illustration, certain references may not be repeated in all drawings.

FIG. 21 is a plan view of the central detail of a rotor similar to the one of FIG. 7;

FIGS. 22.*a* and 22.*b* are plan views of an embodiment of an accessory axial fan vane in accordance with an embodiment of the invention, alone and mounted on a rotor blade, respectively;

DETAILED DESCRIPTION OF THE EMBODIMENTS

Figure 2:
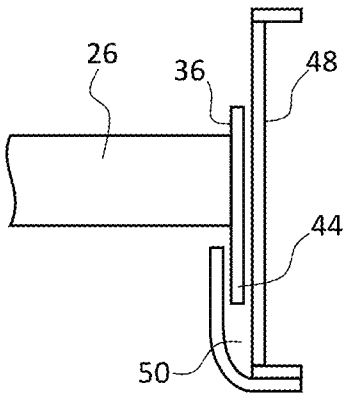
FIG. 2 is a schematic view of the cross-section operated along the line II-II of FIG. 1.
Figure 1:
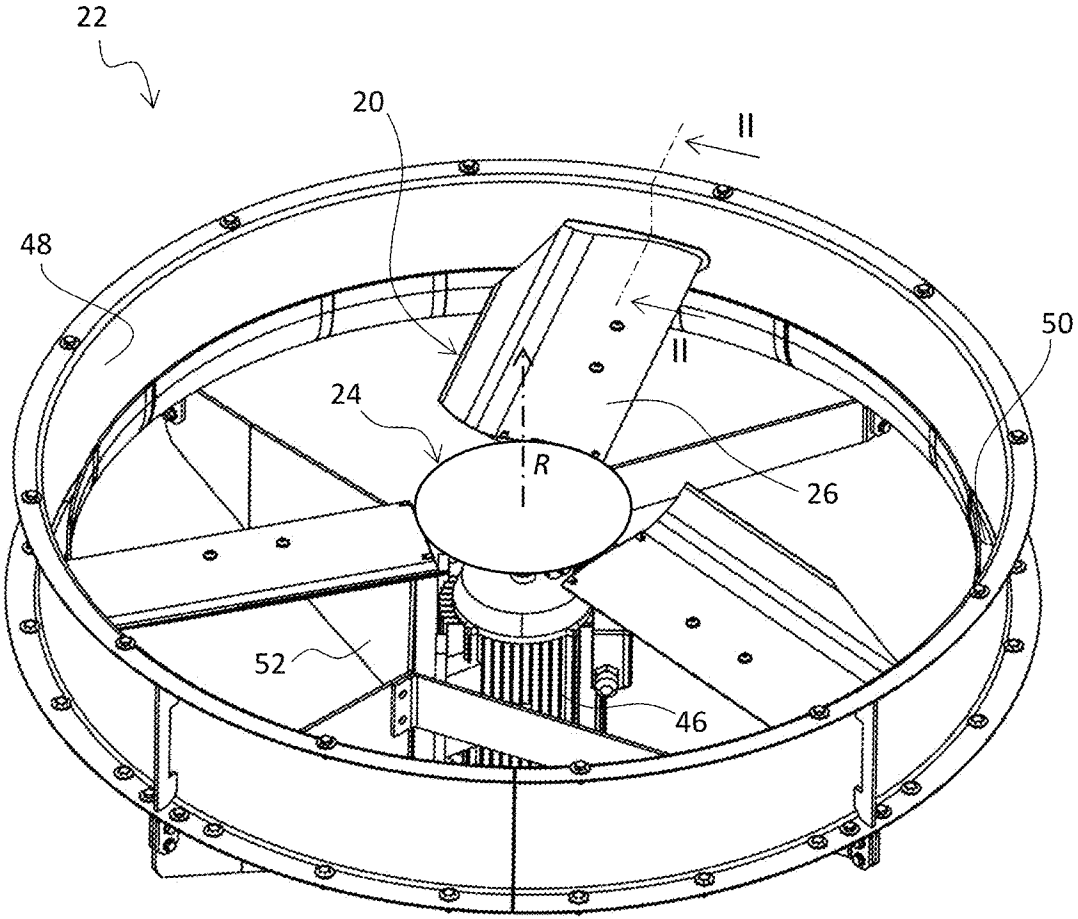
FIG. 1 is an axonometric view of an axial ventilator for industrial use in accordance with the prior art.

While the invention is susceptible to various modifications and alternative constructions, certain preferred embodiments are shown in the drawings and are described hereinbelow in detail. It must in any case be understood that there is no intention to limit the invention to the specific embodiment illustrated, but, on the contrary, the invention intends covering all the modifications, alternative and equivalent constructions that fall within the scope of the invention as defined in the claims.

The description addresses in detail the peculiar technical aspects and features of the invention, while the known aspects and technical features per se can only be mentioned. In these respects, what is stated above with reference to the prior art valid.

The use of "for example", "etc.", "or" indicates non-exclusive alternatives without limitation, unless otherwise indicated. The use of "comprises" and "includes" means "comprises or includes, but not limited to", unless otherwise indicated.

The axial ventilator of the invention defines a rotation axis with respect to which the terms "axial", "radial", "circumferential" and "tangential" are unambiguously defined. Furthermore, the axial ventilator of the invention is configured to generate an airflow with respect to which the terms "upstream", "before" and the like are uniquely defined as opposed to the terms "downstream", "after" and the like.

An aspect of the invention relates to a small accessory axial fan intended to be mounted on the rotor of a large ventilator, itself known. To avoid any ambiguity, the fan of the invention will hereinafter be called the fan, while the large known ventilator will hereinafter be called the ventilator.

In accordance with a first aspect, the invention relates to a rotor 20 for a large diameter axial ventilator 22 for industrial use. The rotor 20 according to the invention comprises a hub 24 and n blades 26, in which each blade 26 of the rotor 20 comprises a root portion 28 for the structural connection to the hub 24 and an aerodynamic portion 30; the rotor 20 according to the invention further comprises a coaxial accessory axial fan 32 comprising n radially extending vanes 34 which, in an axial view, is substantially comprised within the region P defined by the n radially inner ends of the aerodynamic portions 30 of the blades 26 of the rotor 20.

In accordance with the embodiments in the attached figures, in an axial or plan view, the radially inner ends of the aerodynamic portions 30 of the blades 26 are straight and tangentially oriented. For this reason, in such embodiments, the region P defined by the n radially inner ends of the aerodynamic portions 30 is a polygonal region with n sides, in which each side is defined by the chord C, a portion thereof or an extension thereof. Therefore, in such embodiments, the region P takes the form of a regular polygon with n sides. See in this respect FIGS. 12, 15 to 18 and 21. In accordance with other embodiments of the invention, in which the radially inner ends of the aerodynamic portions 30 of the blades 26 assume a different shape, the region P in turn assumes different shapes. In general, the region P assumes a regular shape with central symmetry and can be inscribed in a circle.

Here and below, large-diameter ventilator 22 means a ventilator 22 with a diameter of more than 80 cm, preferably more than 150 cm. In relation to certain technical features which will be described later, reference will be made to a distinction in the context of the large-diameter ventilator 22 to which the invention relates, between so-called small fans, i.e., with a diameter of less than about 5 m, and so-called large ventilator, i.e., with a diameter of more than about 5 m.

The blades 26 of the rotor 20 have a structure known per se and comprise a root portion 28, which performs a purely structural function, and an aerodynamic portion 30, which performs the aerodynamic function of interacting with the airflow. The root portion 28 serves to connect the blade 26 to the hub 24 and is dimensioned so that it can effectively transmit stresses from hub 24 to the aerodynamic portion 30 and vice versa. The aerodynamic function of the blade 26 is performed exclusively by the aerodynamic portion 30, which is shaped according to an airfoil. The aerodynamic portion 30 comprises a radially inner end and a radially outer end, preferably comprising a winglet 36, described further below.

The aerodynamic portion 30 of the blade 26 can be made of metal material (typically aluminium) or composite material (typically fibreglass in an epoxy matrix), depending on specific requirements. Preferably, the aerodynamic portion 30 is obtained from one or more semi-finished products with a constant section, obtained for example by extrusion (in the case where the aerodynamic section is made of metal material) or by pultrusion (in the case where the aerodynamic section is made of composite material).

In accordance with some embodiments, the aerodynamic portion 30 has a constant chord along the entire radial aperture, from the radially inner end to the radially outer end. In accordance with other embodiments, however, the blade 26 is tapered starting from a predetermined position outwards (see FIGS. 1 to 6). In this case, the profile chord of the radially inner end is greater than the profile chord of the radially outer end. In the following, unless otherwise specified, the term "chord" referring to blade 26 is to be understood as the chord C at the radially inner end (see FIG. 12). Depending on the embodiment, C can vary between 100 mm and 1000 mm, preferably between 150 mm and 800 mm.

Figure 14:
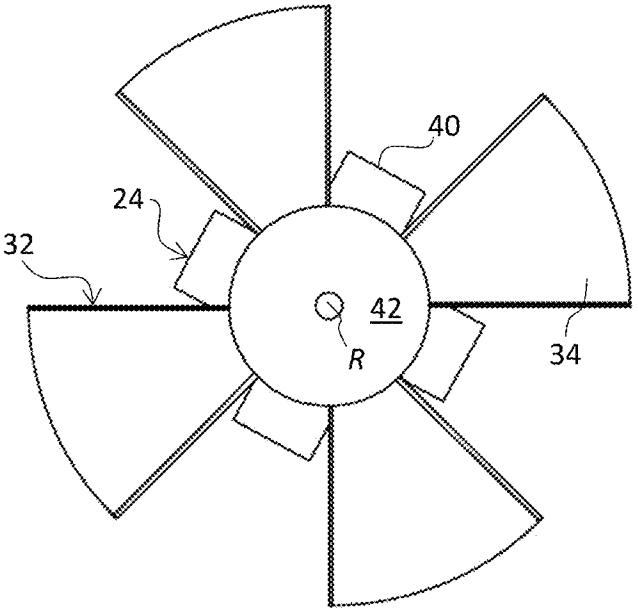
FIG. 14 is a plan view of the assembly of FIG. 13.
Figure 19:
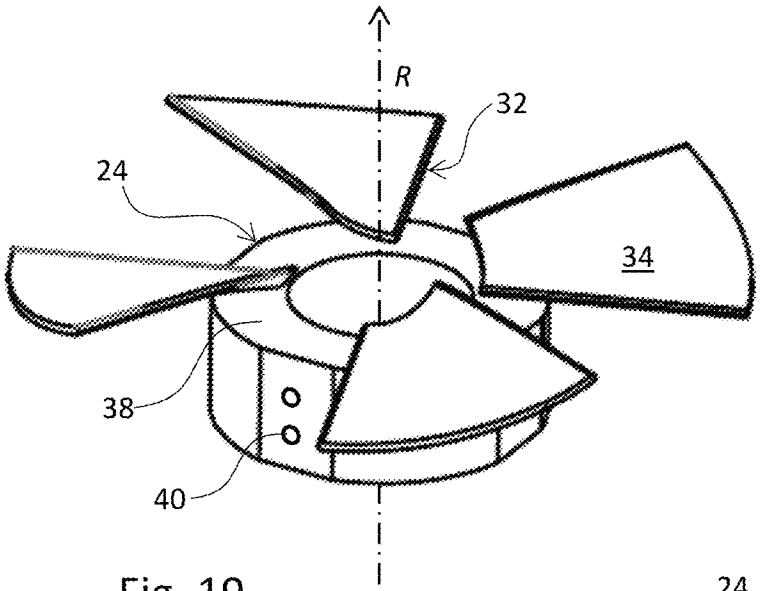
FIG. 19 is an axonometric view of a four-vane accessory axial fan intended for use on a rotor in accordance with an embodiment of the invention.

The hub 24 (see in particular FIG. 13) usually comprises a central portion 38, preferably cylindrical, on which n attachments 40 are arranged, configured to allow the connection of the root portions 28 of the blades 26. In some embodiments, the attachments 40 protrude radially from the central portion 38 of the hub 24 (see for example FIGS. 13 and 14), while in other embodiments the attachments 40 are integrated into the hub 24 (see for example FIGS. 19 and 20).

Preferably the cooperation between each attachment 40 and the corresponding root portion 28 allows the pitch angle $\vartheta$ (or angle of incidence) of the blade 26 to be adjusted, i.e., it allows to vary the orientation of each blade 26 around a respective radial axis of pitch variation. It should be noted, however, that in almost all cases (in particular in the cases shown in the accompanying figures), the rotor 20 of the invention does not permit an effective pitch variation during ventilator 22 operation. Here and below, pitch variation means a reconfiguration of the blades 26 which can only be carried out while the ventilator 22 is stopped, as a maintenance task performed by a technician.

The rotor 20 defines a rotation axis R. In the attached FIGS. 1, 3 and 5-7, the rotation axis R is oriented to indicate the overall direction of the axial airflow generated by the ventilator 22. As already mentioned, the expressions "before", "upstream" and the like are uniquely defined according to the direction of airflow, as opposed to "after", "downstream" and the like.

As mentioned above, the rotor 20 in accordance with the invention comprises a coaxial accessory axial fan 32, i.e., mounted so as to share its geometric axis with the rotation axis R of the hub 24 of the rotor 20.

The accessory axial fan 32 comprises a number n of vanes 34 equal to the number n of blades 26 of the rotor 20. For example, if the rotor 20 comprises three blades 26, then the accessory axial fan 32 comprises three vanes 34 (see for example FIGS. 3 to 6); if the rotor 20 comprises four blades 26, then the accessory axial fan 32 comprises four vanes 34 (see for example FIGS. 7 and 21); if the rotor 20 comprises five blades 26, then the accessory axial fan 32 comprises five vanes 34 (see for example FIGS. 15 to 18); and so on.

As mentioned above, in an axial or plan view of the rotor 20 according to the invention, the accessory axial fan 32 is substantially comprised within the region P defined by the n radially inner ends of the aerodynamic portions 30 of the blades 26 of the rotor 20. Preferably, in the same axial or plan view, the accessory axial fan 32 is entirely comprised within the region P. Referring specifically to FIGS. 12 and 15 to 18, the accessory axial fan 32 is inscribed within the region P, meaning that the radially outer ends of the accessory axial fan 32 lie on the perimeter of the region P.

However, in the context of the present discussion, the term "substantially comprised" takes on a broader meaning, which is explained in more detail below, with particular reference to FIG. 21. The expression "substantially comprised" means that the radially outer ends of the accessory axial fan 32 can protrude from the region P by a measurement f, where f is less than 5% of the diameter d of the accessory axial fan 32 itself.

In accordance with some embodiments of the invention in which the ventilator 22 is of the so-called small type (i.e., it has a diameter of less than about 5 metres), in an axial view the vanes 34 of the accessory axial fan 32 have the shape of a circular sector of angular aperture $\beta$ (see for example FIGS. 3 to 14). The sum of the angular aperture $\beta$ of each of the vanes 34 of the accessory axial fan 32 and the angular distance $\gamma$ between two adjacent vanes 34 depends on the number of vanes 34 according to the simple rule:

$$\beta+\gamma=360°/n$$

In accordance with some embodiments, the angular aperture $\beta$ of a vane 34 is equal to the angular distance $\gamma$ between two adjacent vanes 34:

$$\beta=\gamma$$

From the two relationships above, it follows that the angular aperture of each of the fan vanes 34 depends on the number of vanes 34 according to the simple rule:

$$\beta=360°/2n$$

For example, for the case with three vanes 34 the aperture angle $\beta$ will be 60°, ensuring an equal angle $\gamma$ between the next two vanes 34. For the case with four vanes 34, the aperture angle $\beta$ will be 45°.

In accordance with some embodiments, the accessory axial fan 32 comprises a central portion 42, preferably cylindrical, from which the n vanes 34 protrude radially. Preferably, in an axial view, a characteristic dimension of the central portion 42 of the accessory axial fan 32 is equal to the corresponding characteristic dimension of the central portion 38 of the hub 24 of the rotor 20. In the embodiments of the attached figures, in which both central portions 38 and 42 are cylindrical, the characteristic dimensions in an axial view can be the respective radii or diameters. In particular, the diameter of the central portion 42 of the accessory axial fan 32 is equal to the diameter of the central portion 38 of the hub 24 of the rotor 20 (see FIGS. 13 and 14).

In accordance with other embodiments, the accessory axial fan 32 is obtained by applying the n vanes 34 directly to the rotor 20. For example (see FIGS. 19 and 20), the accessory axial fan 32 can be obtained by attaching the n vanes 34 directly to the hub 24 of the rotor 20. Alternatively (see FIGS. 22.*a* and 22.*b*), each vane 34 of the accessory axial fan 32 can be applied to the radially inner end of the aerodynamic portion 30 of the blade 26. For example, each vane 34 can be applied to the cap 29 that is usually used to close the radially inner end of the aerodynamic portion 30. In accordance with such embodiments, the vanes 34 can be manufactured as independent pieces to then be assembled to form the accessory axial fan 32 directly on the rotor 20.

As mentioned above, the vanes 34 of the accessory axial fan 32 extend in a radial direction; in other words, the vanes 34 extend at least partially in a radial direction, from the central portion 42 of the accessory axial fan 32 or from the central portion 38 of the hub 24, outwards.

Figure 12:
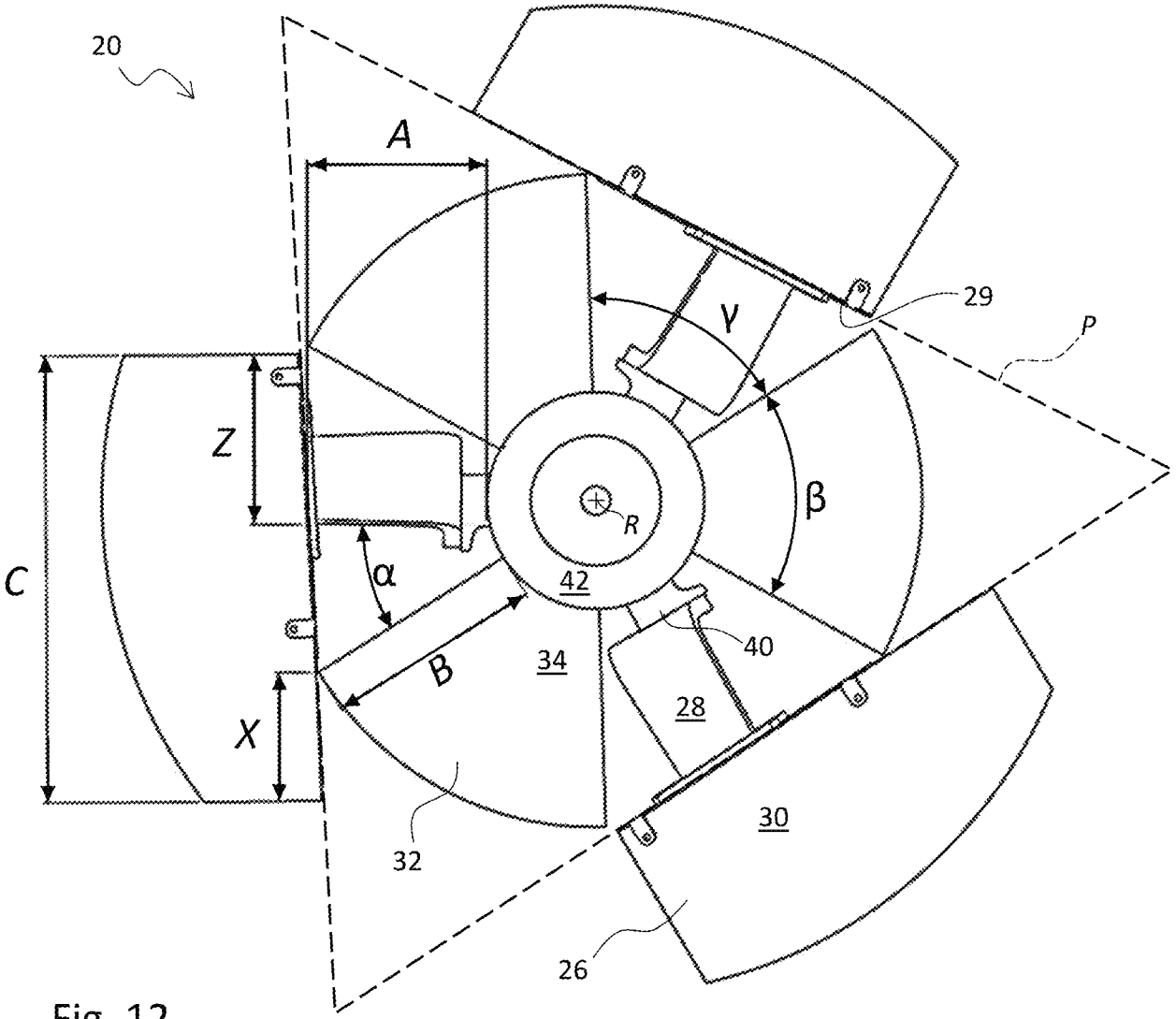
FIG. 12 is a plan view of the central detail of a rotor similar to the one of FIG. 5.

Preferably the radial extension B of the vanes 34 of the accessory axial fan 32 (i.e., half the difference between the diameter d of the accessory axial fan 32 and the diameter of the central portion 38 of the hub 24 or, if present, of the central portion 42 of the accessory axial fan 32; see FIG. 12) is comprised between 60% and 75% of the radius d/2 of the accessory axial fan 32, even more preferably B is comprised between 65% and 70% of the radius d/2 of the accessory axial fan 32.

In accordance with some embodiments, such as those in FIGS. 8 to 11, the accessory axial fan 32 can be made in a single, monolithic piece. Such an embodiment is generally preferable for rotors 20 that are relatively small with respect to the scope of the invention, for example for rotors 20 having a diameter of up to 5 metres. In these cases, in fact, the diameter d of the accessory axial fan 32 is comparable to that of other small ventilator of known types, such as table ventilators for domestic use, or ventilators used for cooling circuits of thermal engines in the automotive sector or in the external units of air conditioners. In other words, in these cases the diameter d of the accessory axial fan 32 is small enough to allow it to be made in a single piece, using the knowledge already acquired by those skilled in the art; the monolithic accessory axial fan 32 can be made, for example, by moulding a sheet metal or by injection moulding or by 3D printing suitable polymers.

In accordance with some embodiments, such as those in FIGS. 15 to 18, the accessory axial fan 32 can be made using a technique similar to that used for the main rotor 20. In other words, the vanes 34 of the accessory axial fan 32 can comprise a root portion 54, for the structural connection to the hub 24 or central portion 42, and an aerodynamic portion 56. Such an embodiment is generally preferable for accessory axial fans 32 intended for relatively large rotors 20, for example intended for rotors 20 with diameters over 5 metres. In these cases, the diameter d of the accessory axial fan 32 is large enough to be able to take advantage of the construction technique used for the main rotors 20 themselves.

With reference to ventilators 22 with a diameter within about 5 metres, in the accessory axial fan 32, the angular aperture β of each vane 34 is preferably equal to the angular distance γ with respect to the adjacent vane 34. This particular configuration implies that, in a plan view and leaving out the central portion 42, the ratio of solids to voids is approximately 1. In other words, the area occupied by the vanes 34 is equal to the area occupied by the air between the vanes 34, regardless of the number n of vanes 34. Such a feature can be particularly appreciated in FIGS. 8 and 10.

In the context of industrial ventilators, the ratio of solids to voids is usually assessed by a parameter called solidity Θ. Traditionally, the solidity Θ of a ventilator 22 is defined as follows:

$\Theta = n*c/D$ where n is the number of blades 26 or vanes 34;

c is the chord at the radially outer end; and

D is the diameter of the ventilator 22 (including the hub 24).

For the accessory axial fans 32 of the invention intended for ventilator 22 within 5 metres in diameter, using the classical formula above, it is obtained that the solidity Θ is preferably comprised between 1 and 2.5, i.e.:

$1 \leq 0 \leq 2.5$.

Figure 8:
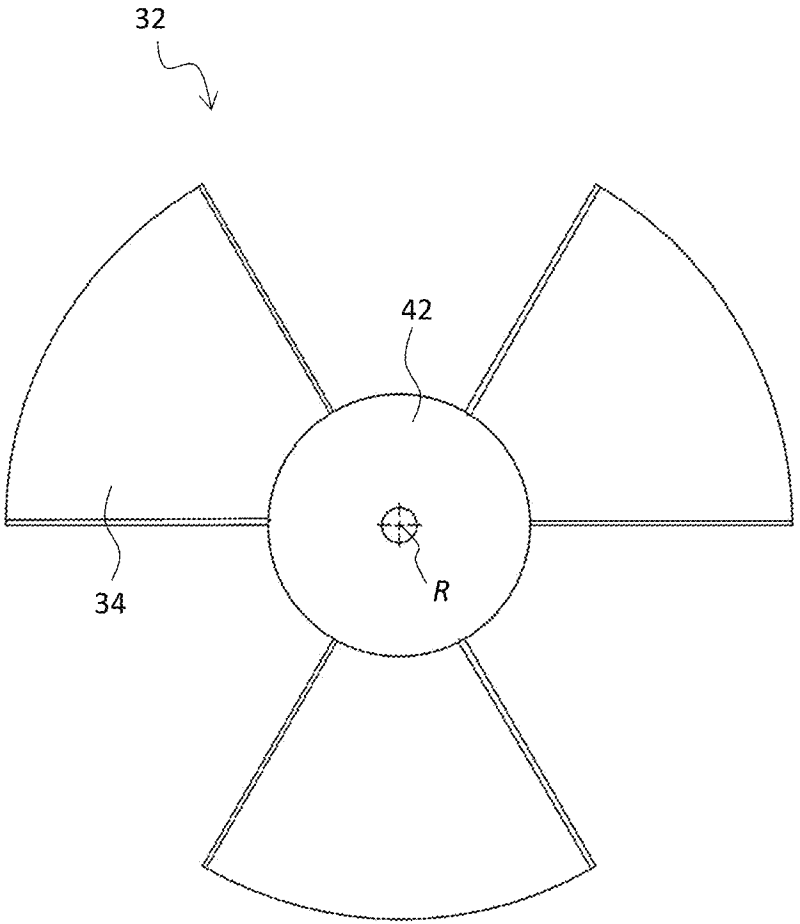
FIG. 8 is a plan view of a three-vane accessory axial fan intended for use on a rotor in accordance with an embodiment of the invention.
Figure 10:
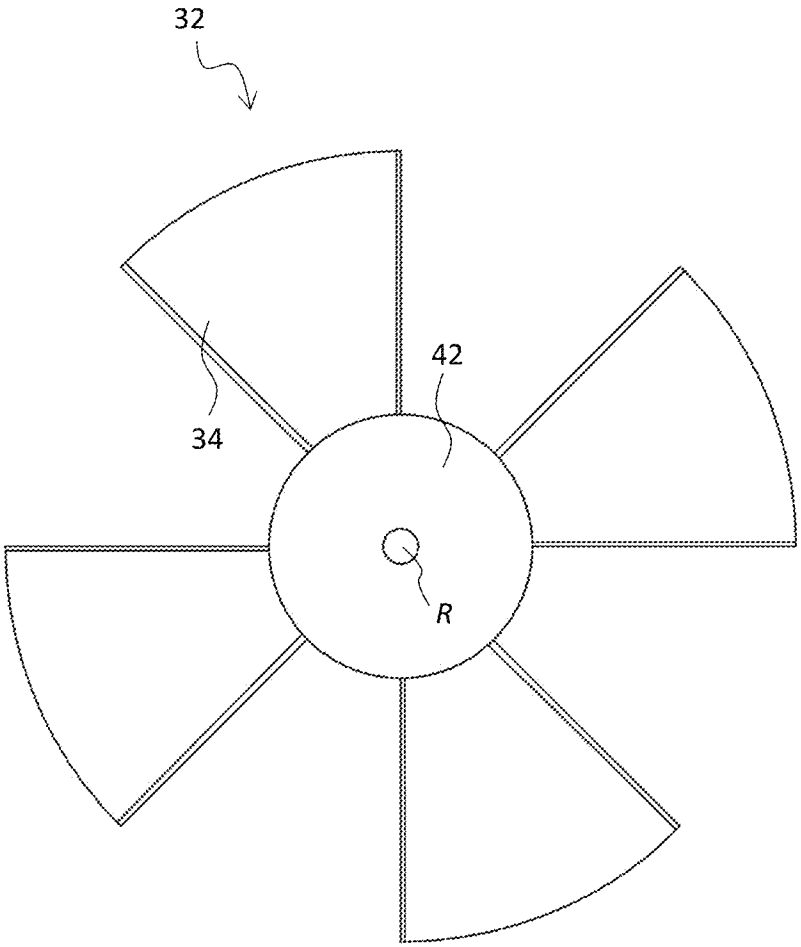
FIG. 10 is a plan view of a four-vane accessory axial fan intended for use on a rotor in accordance with an embodiment of the invention.

More specifically, for the accessory axial fans 32 in attached FIGS. 8 and 10, we have:

$\theta = 1.4$

Figure 13:
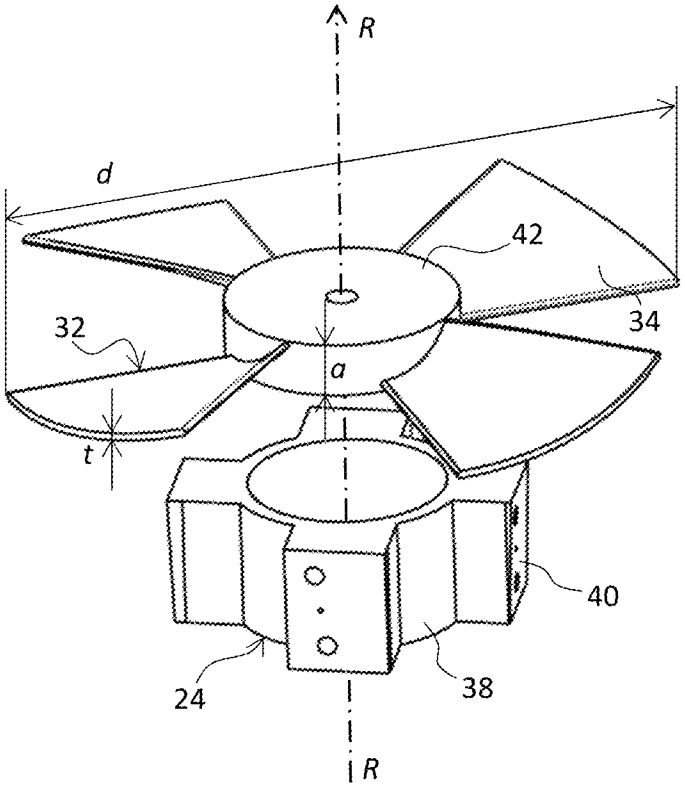
FIG. 13 is an exploded axonometric view of an assembly consisting of a hub and an accessory axial fan similar to those of the rotor of FIG. 7.
Figure 16:
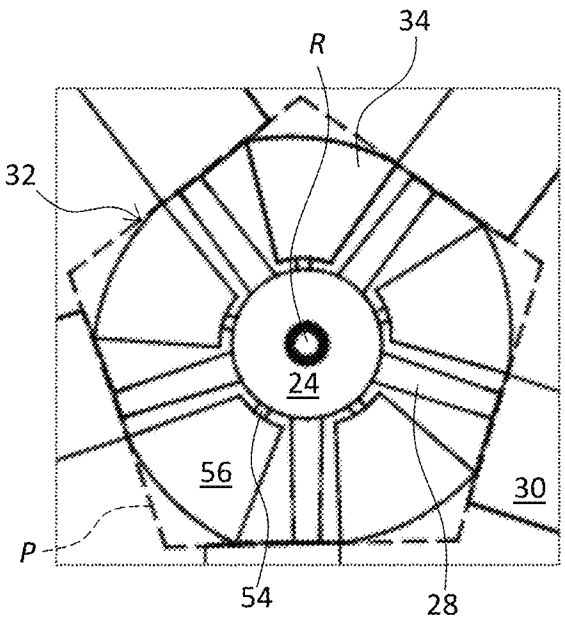
FIG. 16 is an enlarged view of the detail indicated with XVI in FIG. 15.
Figure 15:
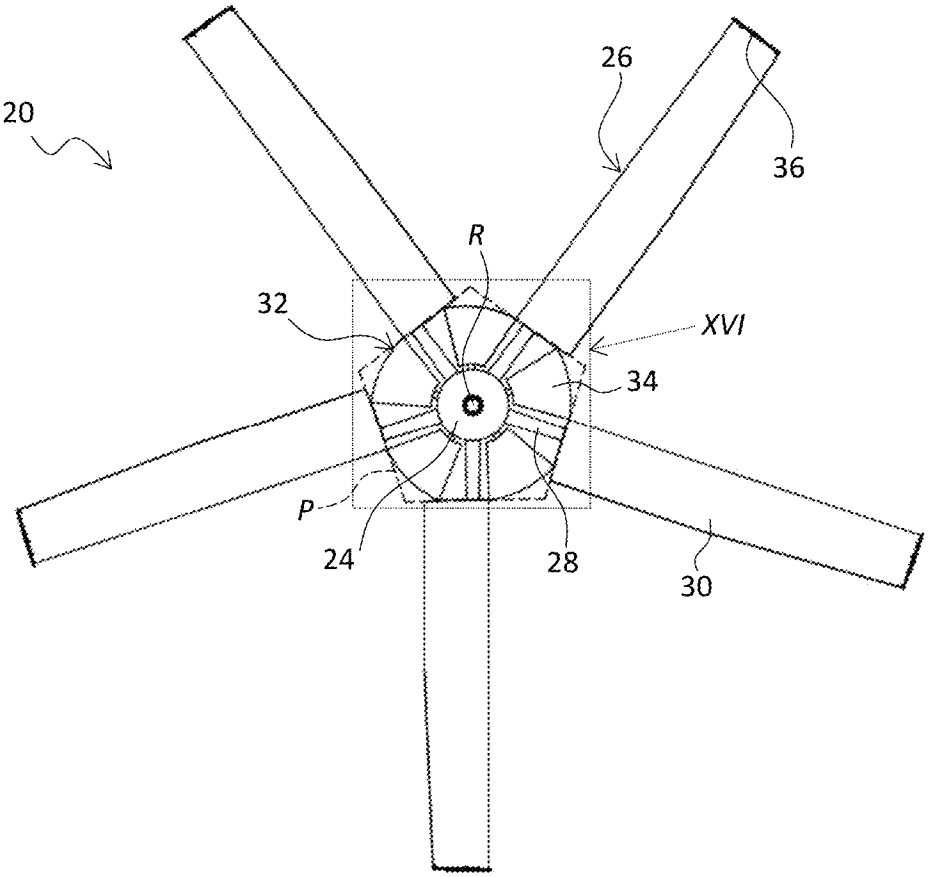
FIG. 15 is a plan view of a five-blade ventilator rotor in accordance with an embodiment of the invention.
Figure 18:
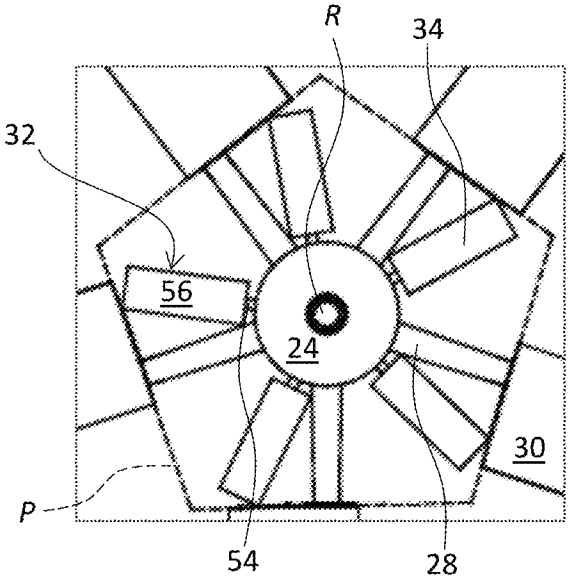
FIG. 18 is an enlarged view of the detail indicated with XVIII in FIG. 17.
Figure 17:
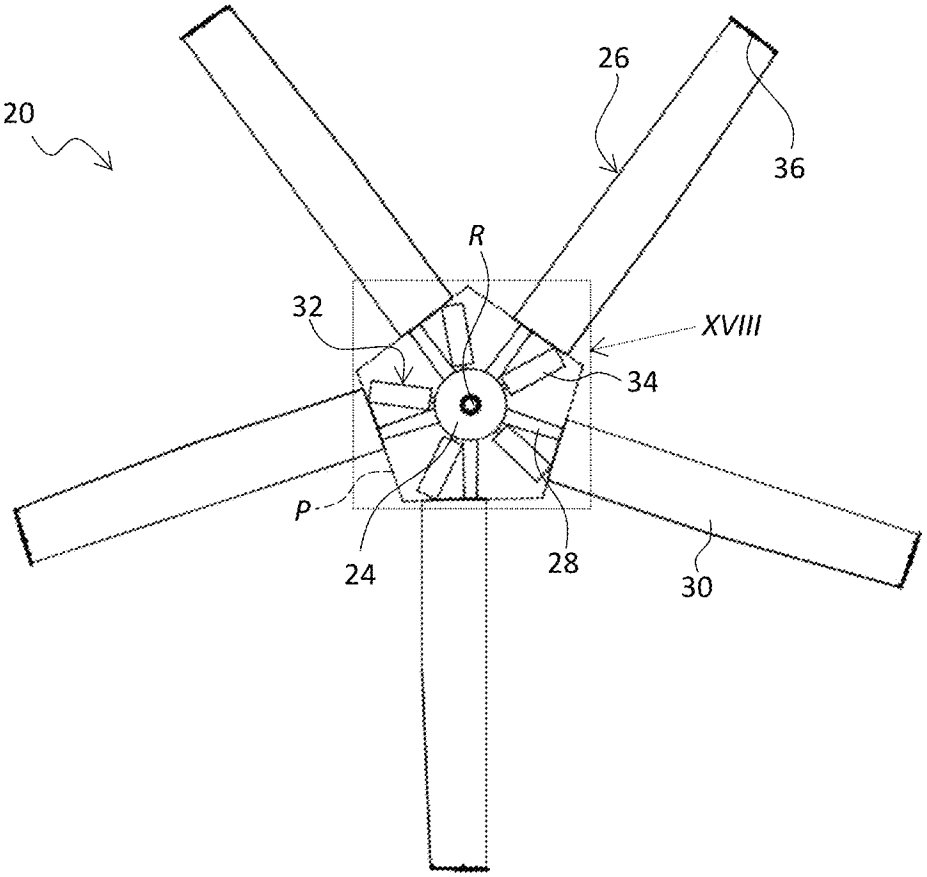
FIG. 17 is a plan view of a five-blade ventilator rotor in accordance with another embodiment of the invention.
Figure 20:
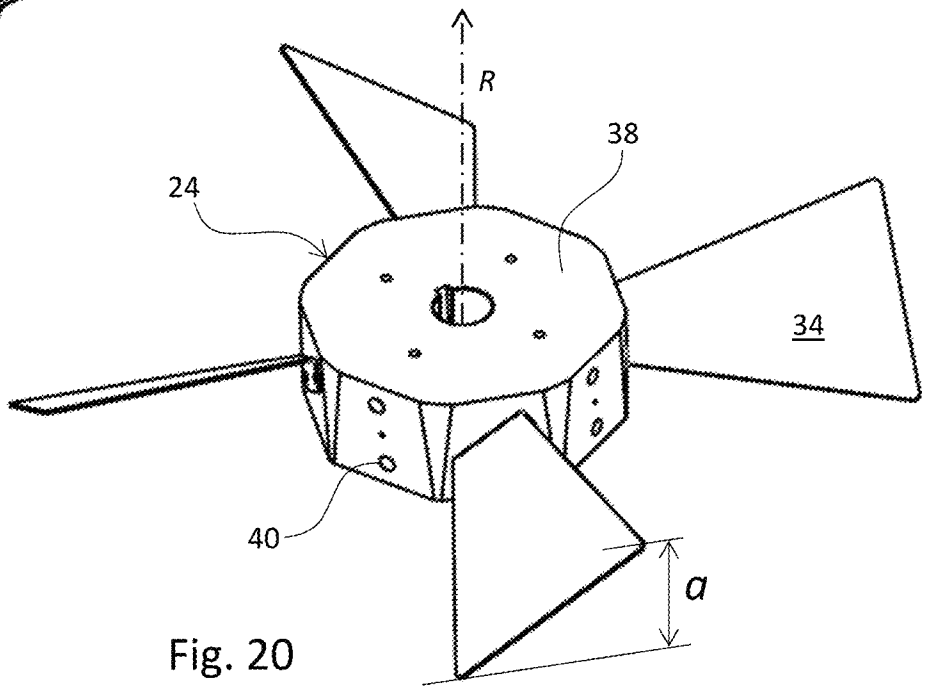
FIG. 20 is an axonometric view of another four-vane accessory axial fan intended for use on a rotor in accordance with an embodiment of the invention.

Preferably the axial extension a of the vanes 34 of the accessory axial fan 32 is comprised within 20% of the diameter d of the accessory axial fan 32 itself, even more preferably the axial extension a is comprised between 5% and 15% of the diameter d, see FIGS. 13 and 20. The axial extension a is hereafter understood as the distance between two planes perpendicular to the rotation axis R, where the first plane comprises the most upstream point of a vane 34 and the second plane comprises the most downstream point of a vane 34. In the embodiment of FIG. 13, the axial extension a of the vanes 34 coincides with the axial extension of the central portion 42 of the accessory axial fan 32.

Figure 9:
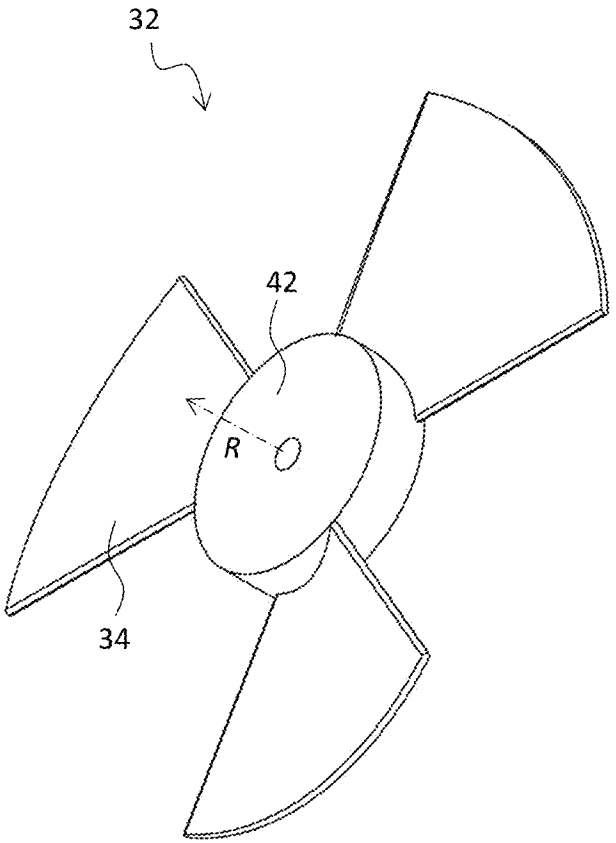
FIG. 9 is an axonometric view of the accessory axial fan of FIG. 8.
Figure 11:
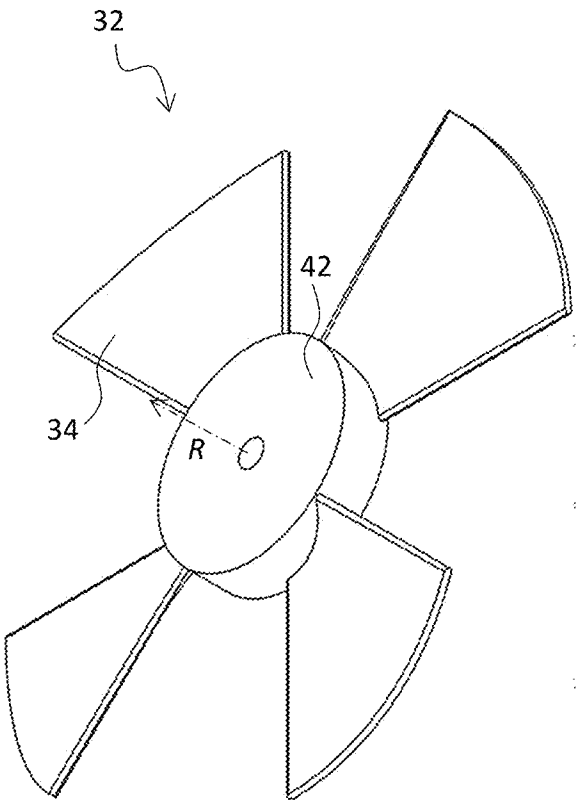
FIG. 11 is an axonometric view of the accessory axial fan of FIG. 10.

Preferably, the thickness t of the vane 34 is thinner with respect to the other dimensions of the vane 34 itself, as can be seen in FIGS. 9, 11 and 13. Preferably, the thickness t of each vane 34 of the accessory axial fan 32 is substantially uniform over the entire extension of the vane 34. The thickness t can be reduced near the perimeter of the vane 34, i.e., near the leading edge and/or the trailing edge and/or the radially outer end of the vane 34. In particular, the thickness t of the vanes 34 of the accessory axial fan 32 is preferably comprised between 10% and 20% of the axial extension a of the accessory axial fan 32. These features of the thickness t make it possible to avoid the formation of vortices at the trailing edge of the vanes 34. This results in each vane 34 conveying air in the preferential direction for the next vane 34 and no interference is generated due to vortex detachment.

The studies conducted by the Applicant have showed the importance of the correct positioning of the accessory axial fan 32 with respect to the rotor 20. Some preferential relationships between the quantities highlighted in FIG. 12 are briefly described below:

C(ϑ) is the projection of the chord of the aerodynamic portion 30 of the blade 26, in particular at the radially inner end, on the plane of rotation; it depends on the size of the airfoil chosen for the aerodynamic portion 30 and the pitch angle ϑ.

B is the radial extension of the vane 34 of the accessory axial fan 32, i.e., the difference between the radius d/2 of the accessory axial fan 32 and the radius of the larger between the central portion 38 of the hub 24 and the central portion 42 of the accessory axial fan 32 (if present);

A is the minimum distance between and the aerodynamic portion 30 of the blade 26 and the central portion 38 of the hub 24, or, the sum of the radial extension of the root portion 28 and the attachment 40 of the hub 24;

α is the angle between the radius along which A is measured and the leading edge of the vane 34 following the blade 26 for which A was measured;

Z is the distance along the chord C between the leading edge of the blade 26 and the point at which A was measured;

X is the distance, along the chord C, between the trailing edge of the blade 26 and the point at which the vane 34 reaches the aerodynamic portion 30 of the blade 26.

Preferably, the position of the accessory axial fan 32 with respect to the rotor 20 is defined by the following equation:

$$X = C(\vartheta) - B\sin(\alpha(\vartheta)) - Z(\vartheta)$$

Which, scaling everything down with respect to the chord C, becomes:

$$X/C = 1 - (B/C)\sin(\alpha) - Z/C = 1 - \beta(\alpha) - \delta$$

Where $\delta = Z/C$

As the pitch angle ϑ increases, the position of the accessory axial fan 32 must be adjusted so as not to overlap with the radially inner end of the aerodynamic portion 30 of the blade 26. By virtue of this, the geometric relation referred to can be defined as follows:

$$B\cos(\alpha) - (c - x)\sin(\vartheta) = 0$$

Where B is the length of the vane 34 in the radial direction, C is the profile chord and X the distance from the trailing edge.

From the above equation in two unknowns, it is possible to find X as a function of α. So we derive α as arcos(((C−X)

sin (ϑ))/B) and inserting it into the equation above, it is possible to find for each pitch angle ϑ the position of the accessory axial fan 32.

A further degree of freedom for positioning the accessory axial fan 32 with respect to the rotor 20 is the axial position. In fact, the accessory axial fan 32 can be arranged adjacent to the axial face of the hub 24, either immediately downstream (as for example in FIG. 5), or immediately upstream (as for example in FIG. 6), or it can be moved in the axial direction along the rotation axis R, at a distance h.

For example, the distance h can be defined such that the radially outer end of the accessory axial fan 32 arrives in the axial direction near the radially inner end of the aerodynamic portion 30 of the blade 26.

For example, we can have:

$$h=(C-Z)\sin(\vartheta)$$

Preferably at least one blade 26 of the rotor 20 of the invention comprises a winglet 36 at its radially outer end. As is well known, the winglet 36 is a shaped device applied to the end of the blade 26 to improve its aerodynamic efficiency, decreasing the induced resistance caused by the end vortices. The winglet 36, known per se, preferably comprises a baffle 44 extending in the axial and circumferential directions.

In accordance with certain embodiments of the invention, the rotor 20 of the invention comprises n blades 26 with V-shaped geometry in plan view. Such a solution (not shown in the attached figures) is described in detail in patent document WO 2017/085134, on behalf of the Applicant. In particular, such V-shaped geometry of the blades 26, in which the leading edge of the blade 26 is concave in a plan view, allows for a significant reduction in the noise generated by the ventilator 22.

In accordance with a second aspect, the invention relates to an axial ventilator 22 for industrial use comprising a rotor 20 as described above and a motor 46. Preferably, the ventilator 22 of the invention comprises an electric motor 46.

Figure 4:
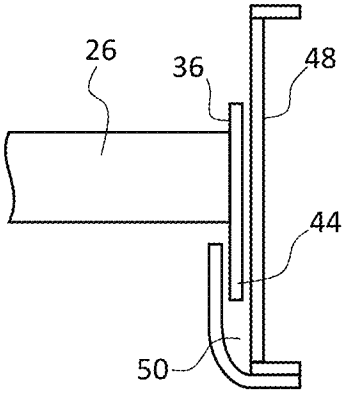
FIG. 4 is a schematic view of the cross-section operated along the line IV-IV of FIG. 3.
Figure 3:
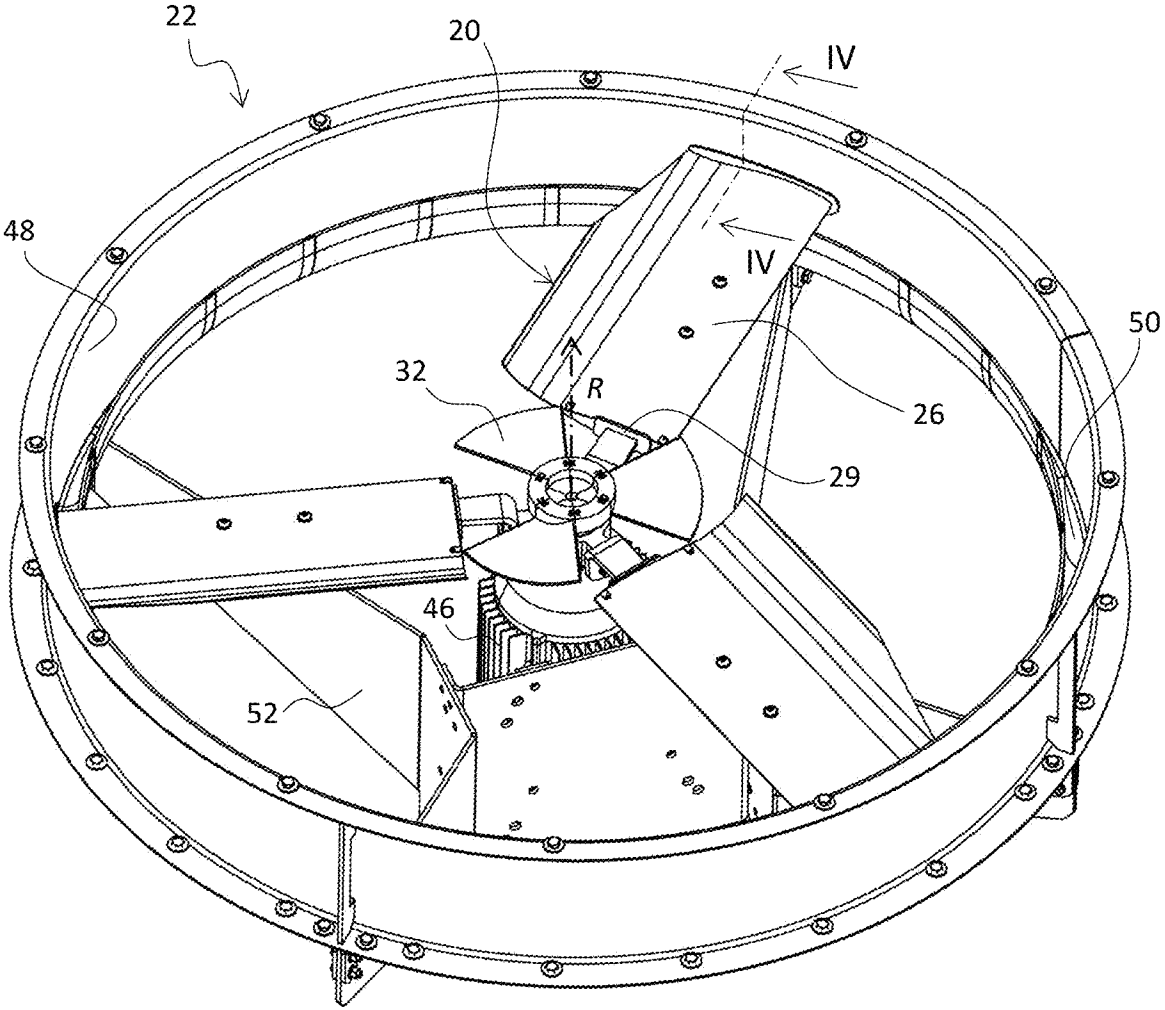
FIG. 3 is an axonometric view of an axial ventilator for industrial use in accordance with an embodiment of the invention.
Figure 6:
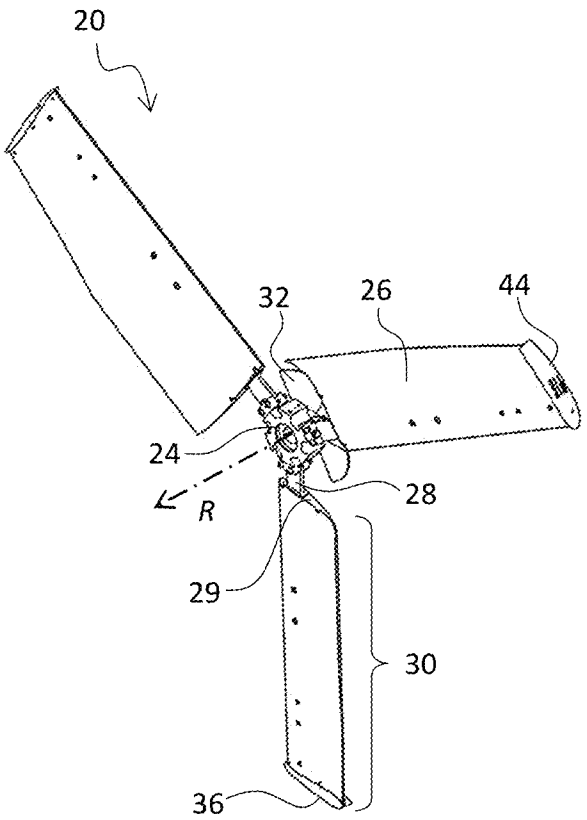
FIG. 6 is an axonometric view of a three-blade ventilator rotor in accordance with an embodiment of the invention.
Figure 5:
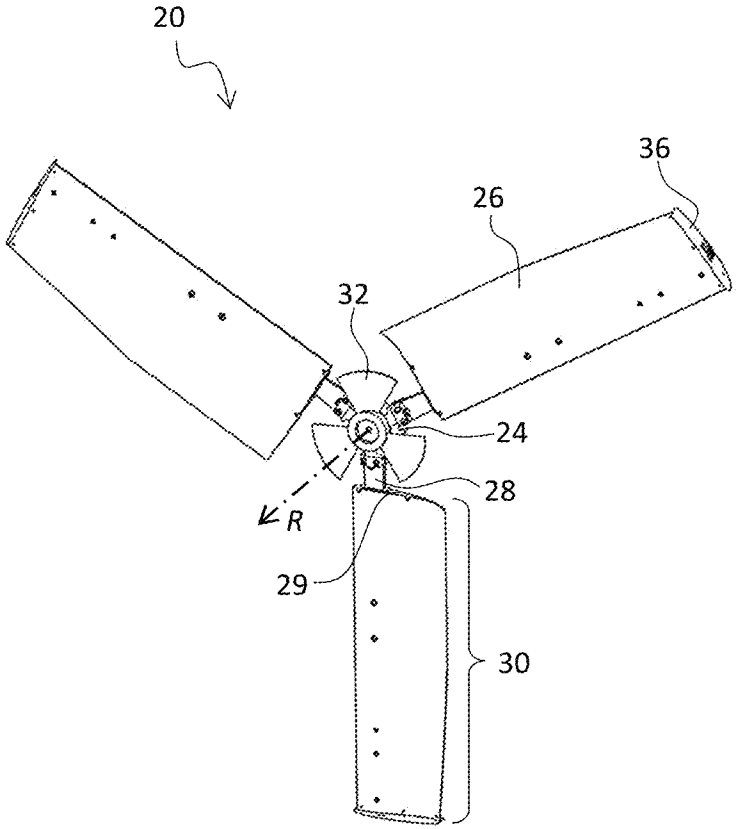
FIG. 5 is an axonometric view of a three-blade ventilator rotor in accordance with an embodiment of the invention.
Figure 7:
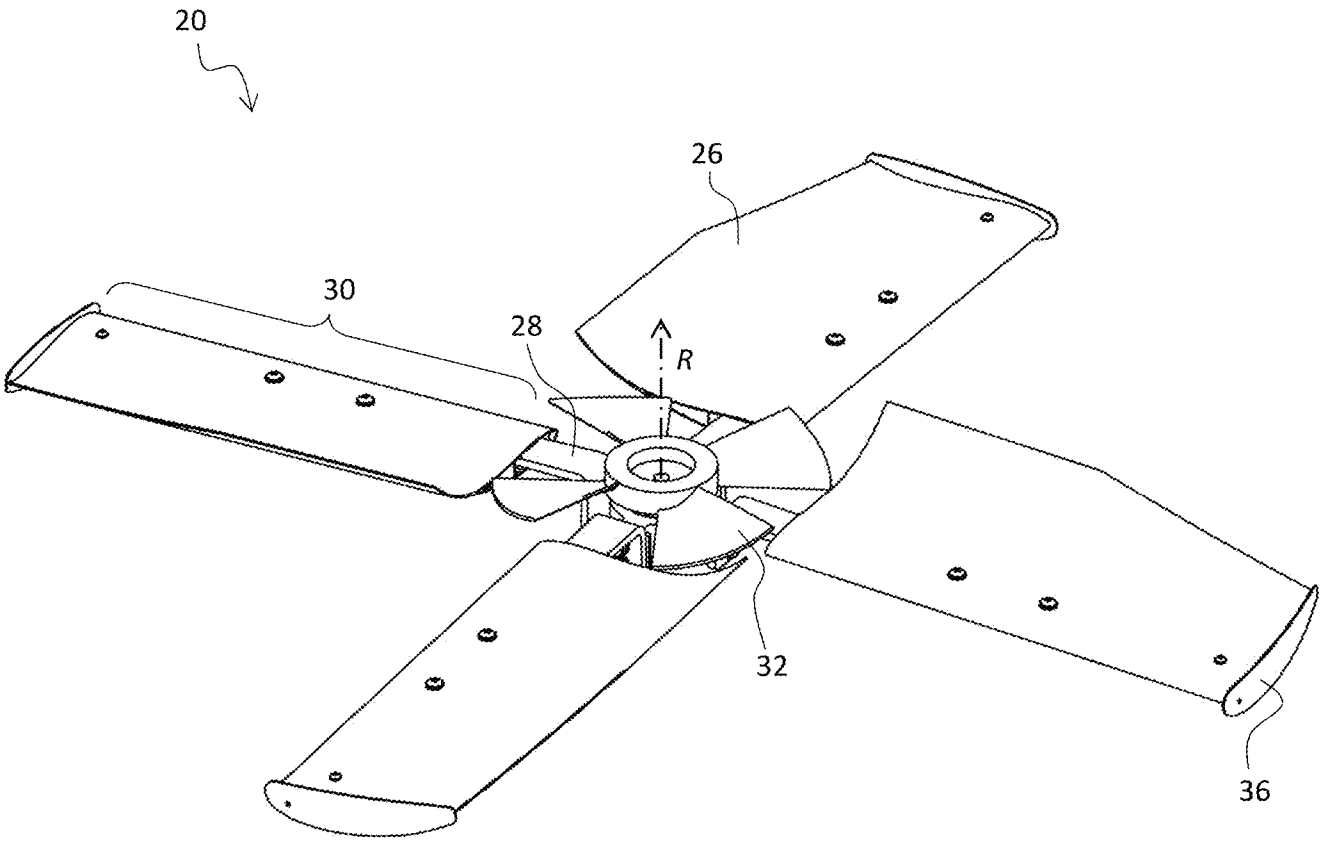
FIG. 7 is an axonometric view of a four-blade ventilator rotor in accordance with an embodiment of the invention.

In accordance with some embodiments of the invention, the ventilator 22 of the invention is a ducted ventilator, i.e., it comprises a duct 48, known per se, surrounding the rotor 20 (see FIGS. 3 and 4).

Preferably, the duct 48 comprises an annular seat 50 as described in patent document WO 2020/245674. In particular, in accordance with such a solution, the inner wall of the duct 48 comprises an annular seat 50 extending circumferentially around the rotor 20 of the ventilator 22 and partially accommodating the outer ends of the blades 26 of the rotor 20. Preferably, the annular seat 50 extends at least partially in the axial direction and partially accommodates the baffle 44 defined by the winglet 36.

In accordance with some embodiments, the ventilator 22 of the invention comprises a framework 52 configured to support the ventilator 22 under all operating conditions. In particular, the framework 52 is configured to firmly support the ventilator 22 at all rotation velocities, in both transient and stationary regimes, without experiencing uncontrolled vibrations.

In accordance with some embodiments, the ventilator 22 of the invention is oriented such that the rotation axis R is vertical and directed upwards. In such a case, the framework 52 and the motor 46 are preferably placed upstream of the rotor 20 (i.e., below the rotor 20) and the framework 52 is firmly anchored to the plant, and thus typically anchored to the ground.

In accordance with certain embodiments, the ventilator 22 of the invention is part of a heat dissipation system comprising a cooling module placed immediately downstream of the ventilator 22 and within which a cooling liquid circulates. In accordance with other embodiments, the ventilator 22 of the invention is part of a ventilation or air movement system. In such a case downstream of the ventilator there is usually a manifold from which one or more ducts branch off to feed a distribution network with the airflow generated by the ventilator 22.

Experimental tests conducted by the Applicant have revealed a significant improvement in efficiency following the introduction of the accessory axial fan 32, regardless of the type of ventilator 22.

In each experimental test, the overall efficiency was calculated, given by the ratio between the measurement (downstream) of flowrate-pressure and the measurement (upstream) of the electrical power absorbed by the motor 46 upstream of the power inverter. Consequently, such overall efficiency, in addition to the aerodynamic efficiency of the rotor 20, which is of most interest for the present discussion, also comprises the contributions of the electrical efficiency of the inverter, the electromechanical efficiency of the motor 46 and the mechanical efficiency of the couplings and transmission. It should therefore be noted that the overall efficiency measured in this manner is greatly penalised by even one inefficient element, such as a poorly performing belt drive or inverter.

The experimental tests conducted by the Applicant involved several different ventilator 22 configurations. The various configurations of the ventilator 22 differed in the number of blades 26, plan form of blades 26, pitch angle ϑ of the blades 26, type of attachment 40 of the blades 26 to the hub 24, presence/absence of the duct 48, presence/absence of the winglets 36, presence/absence within the duct 48 of the annular seat 50 that partially accommodates the radially outer ends of the blades 26. For each specific configuration of ventilator 22 the overall efficiency, described above, was calculated twice: first in the absence of the accessory axial fan 32 and then in the presence of the accessory axial fan 32. The efficiency of the ventilators 22 in the various known configurations was comprised between 41% and 46%, with an average of about 44%. In all the configurations considered, the addition of the accessory axial fan 32 resulted in a noticeable increase in efficiency. The increase in efficiency measured following the addition of the accessory axial fan 32 is comprised between 1.9% and 6.5%, with an average of 3.46%. Such an improvement in efficiency is considerable, but, as those skilled in the art can well understand, by relating it to the aerodynamic component alone (i.e., depriving the overall efficiency measure of all non-aerodynamic contributions), the contribution of the accessory axial fan 32 would be further increased.

Figure 24:
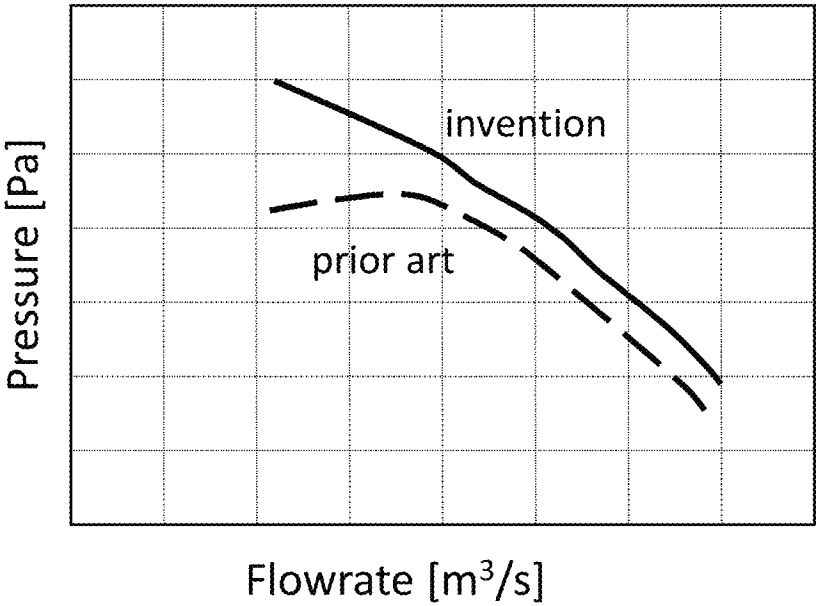
FIG. 24 shows a diagram on the flowrate-pressure plane on which the characteristic curves of a ventilator in accordance with the prior art and of a ventilator in accordance with the invention are schematically shown.

The Applicant also conducted experimental tests to determine the characteristic curves in the flowrate-pressure plane of the ventilators 22 according to the invention, i.e., comprising the accessory axial fan 32. For each of such ventilators 22, the characteristic curve was then compared with the characteristic curve of an entirely identical ventilator 22, but without the accessory axial fan 32. FIG. 24 shows the average trend observed for these characteristic curves in a qualitative manner. In particular, the known type of ventilator 22 comprised a common duct 48, to which the respective accessory axial fan 32 was added to obtain the corresponding ventilator 22 of the invention. In FIG. 24, it can be seen that the arrangement of the accessory axial fan 32 according to the invention allows to obtain two advantages, both of which are significant. Firstly, the accessory axial fan 32 of the invention allows the characteristic curve to be shifted upwards, a result that in the ventilators 22 of known types is achieved by increasing the pitch angle. Secondly, due to the fact that it allows reduced pitch at the same flowrate, the accessory axial fan 32 of the invention allows to reduce or, in some cases, eliminate the stall zone visible in the left portion of the curve characteristic of the prior art. By reducing or eliminating the stall, the ventilator 22 comprising the accessory axial fan 32 of the invention can operate with greater efficiency.

Figure 23:
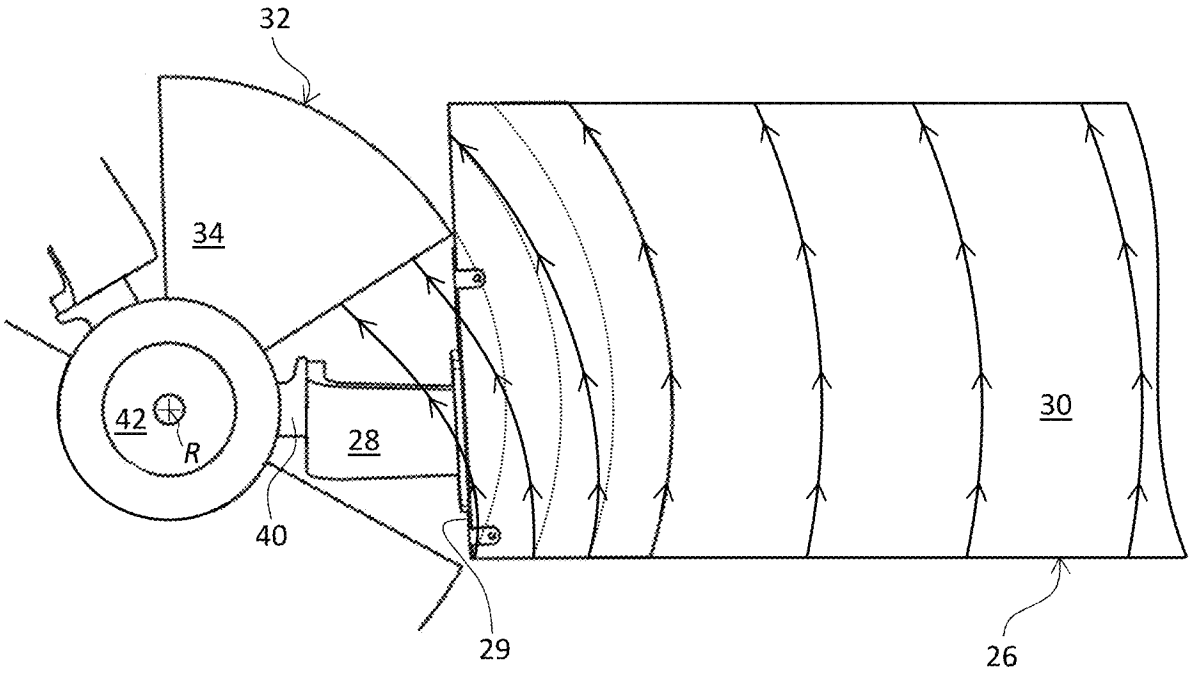
FIG. 23 is a plan view of the central detail of a rotor in accordance with an embodiment of the invention, where theoretical and actual flow lines are schematically highlighted.

Following his own studies and the tests carried out, the Applicant considers that the contribution of the accessory axial fan 32 is not due to the movement of air in the area of the hub 24, i.e. the addition of a further airflow quota in addition to that generated by the main rotor 20. On the contrary, the Applicant considers that the contribution of the accessory axial fan 32 is to stabilise the velocity and pressure field in the radially inner area of the main rotor 20 (i.e., in the area of the root portions 28 of the blades 26), so that the rotor 20 is brought to work better, increasing the overall efficiency. In other words, the presence of the accessory axial fan 32 significantly limits the radial extension of perturbations due to the (inner) end effect, extending the portion of the blade 26 in the radial direction which works close to the optimal point represented by the theoretical flow lines. The effect of the accessory axial fan 32 on the flow in the radially inner area of the rotor 20 is schematically depicted in FIG. 23, where the dotted lines indicate the circumferential arcs centred on the rotation axis R, while the arrows indicate the flow lines. As can be seen in the schematic depiction in FIG. 23, the accessory axial fan 32 is not intended to counteract the recirculation of air in the radially inner area of the rotor 20, but is configured so as to exploit the trend of such a recirculation to stabilise the flow.

An effect similar to that obtained by the accessory axial fan 32 in the rotor 20 of the present invention was also obtained by means of the annular seat 50 described in patent WO 2020/245674. In fact, it was noted that in turn, the annular seat 50, which accommodates at least partially the end of the blades 26 of the rotor 20, significantly limits perturbations due to the (outer) end effect, extending the portion of the blade 26 in a radial direction that works close to the optimum point represented by the theoretical flow lines.

Figure 25:
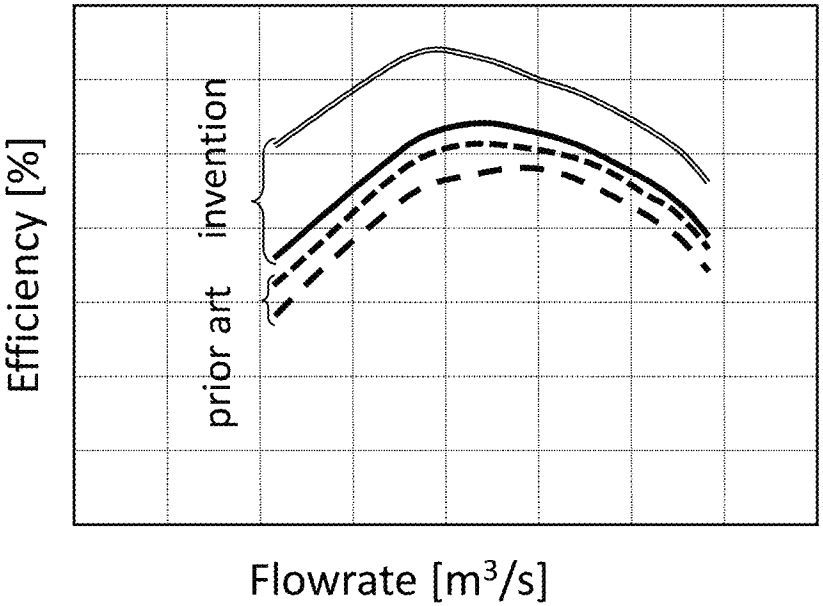
FIG. 25 shows a diagram on the flowrate-efficiency plane on which the characteristic curves of two ventilators in accordance with the prior art and of two ventilators in accordance with the invention are schematically shown.

With specific reference to the interaction between the accessory axial fan 32 of the present invention and the annular seat 50 described in patent document WO 2020/245674, the Applicant has conducted various experimental tests to determine the trend in efficiency as a function of the flowrate when the configuration of the ventilator 22 changes. In FIG. 25, significant curves are shown in a qualitative manner that summarise the result of the entire experimental campaign in a schematic and immediately comprehensible manner, which is briefly described below.

In the preliminary stages of the experimental campaign, a number of known types of ventilators 22 were identified, differing from each other in one or more design parameters such as the number of blades, diameter, type of profile, pitch angle, etc. All of the ventilators 22 considered in the experimental campaign had in common the use of winglets 36 and a duct 48, both of the traditional type. Subsequently, for each type of ventilator 22 the following were prepared and maintained:

- the accessory axial fan 32 in accordance with the present invention; and
- the annular seat 50 described in WO 2020/245674, i.e., open in the axial direction and adapted to partially accommodate the baffle 44 of the winglet 36.

In the operating steps of the experimental campaign, the curve showing the variation of efficiency as a function of flow rate was plotted experimentally for each type of ventilator 22 in four different configurations of the same ventilator 22:

- Basic configuration, in accordance with the prior art. In such a basic configuration, the ventilator 22 comprises only the winglets 36 and the duct 48.
- First improved configuration, in accordance with the prior art. Such a configuration is obtained from the basic configuration, with the addition of the annular seat 50 described in WO 2020/245674.
- Second improved configuration in accordance with the present invention. Such a configuration is obtained from the basic configuration, with the addition of the accessory axial fan 32 of the present invention.
- Third improved configuration in accordance with the present invention. Such a configuration is obtained from the basic configuration, with the addition of the annular seat 50 described in WO 2020/245674 and the accessory axial fan 32 of the present invention.

FIG. 25 shows four different curves schematically depicting the curves obtained for each of the configurations identified above, where:

- the curve related to the basic configuration (part of the prior art) is the dashed one with long strokes
- the curve related to the first improved configuration (part of the prior art) is the dashed one with short strokes;
- the curve related to the second improved configuration (part of the invention) is the continuous single-stroke one;
- the curve related to the third improved configuration (part of the invention) is the continuous double-stroke curve.

As can be noted, all the improved configurations have a curve translated upward with respect to the basic configuration. This means that the introduction of each of the improvements generally results in an increase in the efficiency of the ventilator 22 for the same air flowrate developed. A different phenomenon that can be observed is the migration of the point of maximum efficiency, although such a phenomenon is of no interest in the present discussion.

A far more interesting observation concerns the magnitude of the upward shift of the different curves. In particular, it can be noted that the addition of only the annular seat 50 (first improved configuration) results in an appreciable improvement, comparable to that obtained by adding only the accessory axial fan 32 (second improved configuration).

What is really surprising is the combined effect of the two improvements. As can be clearly seen in FIG. 25, the increase in efficiency obtained by the application of both improvements (third improved configuration) is clearly greater than the sum of the increases registered with the disjointed application of the same improvements, i.e., first the annular seat alone 50 and then the accessory axial fan alone 32. On the basis of the results of the studies conducted, the Applicant considers that in the third improved configuration, the simultaneous presence of the annular seat 50 and the accessory axial fan 32 makes it possible to stabilise the velocity and pressure range both in the radially inner area of the rotor 20, thanks to the accessory axial fan 32, and in the radially outer area of the rotor 20, thanks to the annular seat 50 which accommodates the baffle 44 of the winglets 36. Thereby, the entire ventilator 22 works at its best, increasing its overall efficiency.

In the light of the above, the skilled person can well understand how the presence of both solutions in the same ventilator 22 leads to a particularly preferable embodiment, in which the radial extension of the portion of the blade 26 working close to the optimal point represented by the theoretical flow lines is maximised. It should be noted that the overall improvement in performance described above can allow, in some cases, to employ a ventilator 22 according to the invention having one less blade with respect to the conventional ventilator 22 in which would have been required; for example, in some cases a three-blade ventilator 22 according to the invention can ensure the performance of a four-blade ventilator 22 according to the prior art.

Furthermore, the improvement in overall efficiency may allow, in some cases, a less powerful motor to be used on a ventilator 22 according to the invention than would be required to drive a conventional ventilator 22 with the same performance.

As those skilled in the art can well understand, these results allow to limit the investment and management costs of ventilator 22.

As those skilled in the art can well understand, the invention overcomes the drawbacks highlighted above in relation to the prior art.

In particular, the invention provides an axial ventilator 22 that has improved efficiency.

Furthermore, the invention provides an axial ventilator 22 that can develop higher pressures at the same speed with respect to ventilators of the known type.

Furthermore, the invention provides an axial ventilator 22 that limits the formation of end vortices more with respect to the known type of ventilators.

Again, the invention provides an axial ventilator 22 that allows flow lines to be regularised by making them as close as possible to those envisaged by theory.

Finally, the invention provides a ducted axial ventilator 22 that not only introduces further advantages, but also retains the advantages already achieved by the known types of ventilators.

In conclusion, all the details can be replaced with other technically-equivalent elements; the features described in connection with a specific embodiment can also be used in other embodiments; the materials used, as well as the contingent shapes and dimensions, can be any according to the specific implementation requirements without thereby falling outside the scope of protection of the following claims.

The invention claimed is:

1. A rotor for a large diameter axial ventilator for industrial use, comprising: a hub and n blades, wherein each blade of the rotor comprises a root portion for the structural connection to the hub and an aerodynamic portion, the rotor further comprising an accessory axial fan which comprises n radially extending vanes and which, in an axial view, is substantially comprised within a region P defined by the n radially inner ends of the aerodynamic portions of the blades of the rotor.

2. The rotor according to claim 1, wherein, in an axial view, the accessory axial fan is inscribed within the region P.

3. The rotor according to claim 1, wherein the accessory axial fan comprises a central portion from which the n vanes radially extend.

4. The rotor according to claim 1, wherein the accessory axial fan is formed by applying n independent vanes directly on the rotor.

5. The rotor according to claim 1, wherein a radial extension of the vanes of the accessory axial fan is between 60% and 75% of a radius d/2 of the accessory axial fan.

6. The rotor according to claim 1, wherein an axial extension of the vanes of the accessory axial fan is within 20% of a diameter of the accessory axial fan.

7. The rotor according to claim 1, wherein the vanes of the accessory axial fan comprise a root portion for the structural connection to the hub, and an aerodynamic portion.

8. The rotor according to claim 1, wherein the accessory axial fan is made in an integral, monolithic piece.

9. The rotor according to claim 1, wherein a thickness of each vane of the accessory axial fan is substantially uniform over the entire extension of the vane.

10. The rotor according to claim 1, wherein a thickness of the vanes of the accessory axial fan is between 10% and 20% of an axial extension of the vanes of the accessory axial fan.

11. The rotor according to claim 1, wherein at least one blade comprises a winglet at the radially outer end and wherein the winglet comprises a baffle which extends in the axial and circumferential directions.

12. An industrial ventilator, comprising: a rotor according to claim 1 and a motor.

13. The industrial ventilator according to claim 12, further comprising a duct which surrounds the rotor.

14. The industrial ventilator according to claim 13, wherein the duct comprises an annular seat which circumferentially extends around the rotor and which partially houses the outer ends of the blades of the rotor.

15. The industrial ventilator according to claim 14, further comprising a rotor having at least one blade comprising a winglet at the radially outer end and wherein the winglet comprises a baffle which extends in the axial and circumferential directions, and wherein the annular seat extends at least partially in the axial direction and partially houses the baffle defined by the winglet.

* * * * *